US006774756B2

(12) United States Patent
Zhao

(10) Patent No.: US 6,774,756 B2
(45) Date of Patent: Aug. 10, 2004

(54) FUNCTIONAL MATERIAL-COMPOSITE STRUCTURAL MAGNETIC CORE

(76) Inventor: Qiang Zhao, Room 301, unit 2, Building 16 Zhanchunyuan, Haidian District, Beijing (CN), 100083

( * ) Notice: Subject to any disclaimer, the term of this patent is extended or adjusted under 35 U.S.C. 154(b) by 68 days.

(21) Appl. No.: 10/126,881

(22) Filed: Apr. 22, 2002

(65) Prior Publication Data

US 2002/0153981 A1 Oct. 24, 2002

(30) Foreign Application Priority Data

Apr. 24, 2001 (CN) ..... 01241343 U
Jun. 18, 2001 (CN) ..... 01227200 U

(51) Int. Cl.[7] ..... H01F 27/02

(52) U.S. Cl. ..... 336/83; 336/206; 336/212; 336/229

(58) Field of Search ..... 336/83, 206–208, 336/212, 213, 219, 229, 233, 234

(56) References Cited

U.S. PATENT DOCUMENTS 3,609,613 A * 9/1971 Horn ..... 336/229
5,838,220 A * 11/1998 Hagberg ..... 336/206

FOREIGN PATENT DOCUMENTS

JP 55-82423 * 6/1980

* cited by examiner

*Primary Examiner*—Tuyen T. Nguyen
(74) *Attorney, Agent, or Firm*—Rabin & Berdo, P.C.

(57) ABSTRACT

A functional material—composite structural magnetic core is the magnetic core mainly consisting of magnetic material and having regular geometric form. It includes a box with a slot cavity and through hole. The inner magnetic core is installed inside the cavity of the box. It is characterized by: there are multiple inter-layers inside of the cavity of the slot. The inter-layers divide the slot cavity into the multiple continued ring slot and inside the ring slot many inner magnetic cores are installed respectively. The advantages are: wide application frequency band, large application temperature range, expanded electromagnetic compatibility. The continued stability and sudden change of the electromagnetic characteristics can meet requirements of the electronic technology. The sensing and sending of power transferred signal and control of noise wave etc. showed its composite excellent performance, corresponding and matching characteristics.

10 Claims, 2 Drawing Sheets

FUNCTIONAL MATERIAL-COMPOSITE STRUCTURAL MAGNETIC CORE

FIELD OF THE INVENTION

The utility model is related to magnetic devices and components, especially the functional material—composite structural magnetic core.

BACKGROUND OF THE INVENTION

At present the majority of magnetic devices and components used in the electric power, electronics and communications, are made of a single magnetic material, such as ferrite, Ferrocart core, permalloy, non-crystal material, micro crystal material, silicon steel etc., and are also made of two different kinds of magnetic material which are made into pieces and lapped together to make the magnetic core. Neither the magnetic core made of a single material nor the two sorts of lapped different materials can bring the comprehensive function of the multi-material into efficient play. For example, the saturation induction density of the high magnetic conductivity ferrite and the nickel-zinc high frequency ferrite is not high; the magnetic conductivity is low; temperature stability is general and the Curie point is low. However, its application range of the frequency is as wide as to megahertz level. Its stress sensitivity is not strong, but the price is cheap. The magnetic conductivity of the Ferrocart core is low. Its stress sensitivity is not strong. The saturation induction density is high and the price is cheap. The performance of low frequency AC and DC for the silicon steel is good; stress sensitivity is not strong and the price is low. The permalloy has the excellent integrated soft magnetic performance of low frequency and medium frequency; but the price is high and the stress sensitivity is strong. Non-crystal and micro crystal alloy soft magnetic material has a soft magnetic performance of low frequency and medium frequency; however the stress sensitivity is strong and the price is high. The performance of all the single materials has good and bad features. If the advantages of the materials are gathered, the use of the combined material will be needed. Through change of the combined structure, the B-H magnetic hysteresis loop change is reached to cause related parameter change of electromagnetic characteristic to get continuous and sudden change of magnetic characteristics to be suitable for the demands of the continuous development of the electric, electronic and telecommunication technology.

SUMMARY OF THE INVENTION

The technical problems to be solved with the utility model is to provide a functional material—composite structural magnetic core made of one or multiple magnetic material in line of above the existing technical inadequacy to realize the multiple purpose through simple structural change.

The above technical problem of the utility model is solved by means of following technical alternatives.

A functional material—composite structural magnetic core is the magnetic core mainly consisting of magnetic material and having the regular geometric form, including a box with slot cavity and through hole, the inner magnetic core installed in the slot cavity of the box. It is characterized by: there are multiple inter layers inside of the slot cavity. The inter-layers divide the slot cavity into the multiple continued outer slot. Inside the ring slot there are installed many inner magnetic cores.

The magnetic material such as silicon steel, ferrite or Ferrocart etc. is used to make quasi-spherical, round, oval or rectangular ring box with cavity and holes. On the ring box the ring box cover is provided, which is made of magnetic material such as silicon steel, ferrite, Ferrocart, radial permanent ferrite and neodymium-iron-boron etc. The inner slot of the ring box is filled with magnetic material core such as powdered magnetic material, blender and super-micro crystal (nano crystal) and non-crystal, permalloy, and silicon steel etc. The core can be single layer or multiple layers. The outer wall and inner wall of the hole of the round, oval or rectangular rings of the ring box and the cover there is attached or covered with the insulation layer of insulation not lower than 16V. The equivalent diameter of inner ring for quasi-spherical, round, oval and rectangular ring box with cavity and hole is 0.000005–1200 mm. The equivalent diameter of outer ring is 0.00001–1600 mm. The height of the box is 0.00001–2000 mm. The individual unit of the ring box and the cover may be seamless.

The cover of round, oval and rectangular ring box may be round, oval and rectangular ring box corresponding to the ring box and the box cover is aligned with it, so the cover is corresponding to the slot of the box. The material of the ring box cover may be same and may not be same as the ring box. The inner slot of the ring box can be single or multiple. The slot wall thickness is not smaller than 0.0000005 mm. The ring type interlayer slot wall can be set up within the slot. The slot wall can be made of magnetic material or insulation material, super conductive material and shielding material such as soft magnetic ferrite, permanent ferrite, neodymium-iron-boron etc. The magnetic core inside the slot may be big equivalent diameter that covers the small equivalent diameter. The cover may be made open. The width of the continuous regular opening should be not smaller than 0.0000002 mm. At the opening the magnetic material or the insulation material spacer with same width of permanent magnetic ferrite, neodymium-iron-boron etc. should be added. When insulation interlayer is added in the slot, it can be sleeve type. At the upper and lower sides the magnetic material or insulation material spacer such as permanent magnetic ferrite and neodymium-iron-boron etc. should be set up. When multiple layer magnetic cores are used, the washer of magnetic material and super conductive material and shielding material or insulation material such as soft magnetic ferrite can be added between the magnetic cores.

The insulation material can be used for various material such as ABS overlay, PVC, PEK, PEK, PBT, polytetrafluoroethylene and nylon 66 etc. and can be made into round, oval and rectangular ring sleeve.

The box with the slot cavity and the through hole is the tubular ring box with section of rectangular slot cavity. The tubular ring box is the round ring type or oval ring type or rectangular. The so-called through hole is the center hole of the ring.

The box with slot cavity and the through hole is the twin layer wall quasi-ball, over which there is provided the through hole connecting the inner and outer layer walls. Between the hole wall of the through hole and the inner and outer layer walls the slot cavity connected with each other is formed.

The tubular ring box with section of rectangular slot cavity consisted of U type ring slot box and ring box cover topped on the type opening of the U type ring slot box.

The ring type box of the rectangular tubular section consisted of U type ring slot box and ring box cover of U type ring slot form. The ring box cover of the U type ring slot form will be topped on the U type ring slot box.

The multiple inner magnetic cores installed in the multiple ring slots are made of single or multiple layers of different magnetic material or same magnetic material.

The box body and its cover are made of high magnetic conductivity ferrite or power ferrite or Ferrocart. The inner magnetic core is made of the high magnetic conductivity ferrite, power ferrite, Ferrocart, permalloy, non-magnetic material, micro-crystal magnetic material.

The outside of the box with the slot cavity and the through hole is wrapped with insulation layer. Between the inner magnetic core and slot cavity there is installed the insulation layer.

Above and below the inner magnetic core there is provided the magnetic or insulation washer.

Over the inner magnetic core there is set up the opening, at which the equal-width magnetic or insulation spacer is put in.

The advantages of the utility model: widened application frequency band, expanded application temperature range, and electromagnetic compatibility characteristics. The continued stability and sudden change of the electromagnetic characteristics can meet requirements of the electronic technology. The sensing and sending of power transferred signal and control of noise wave etc. showed its composite excellent performance, corresponding and matching characteristics. The different performance requirement can be realized by simple changing the structure only, for example, changing the cover or the magnetic core. It is difficult to do this with the existing technology.

The further detailed description for the utility model will be made in combination with following attached figs and embodiments.

DETAILED DESCRIPTION OF THE INVENTION

As shown in the FIGS. 1, 2, 3, 4, 5, 6 the functional material—composite structural magnetic core provided by the Utility Model is the magnetic core which is made of magnetic material and has a regular geometric form. Among them, it includes an outer magnetic core that includes a box with a slot cavity and a through hole. The inner magnetic core 3 is installed in the slot cavity of the box. It is characterized by: the inside the slot cavity, there are provided the multiple inter-layers 5. The inter-layers 5 divide the slot cavity into connected through multiple ring slots. In the ring slots there are installed the multiple inner magnetic cores 3.

Figure 1:
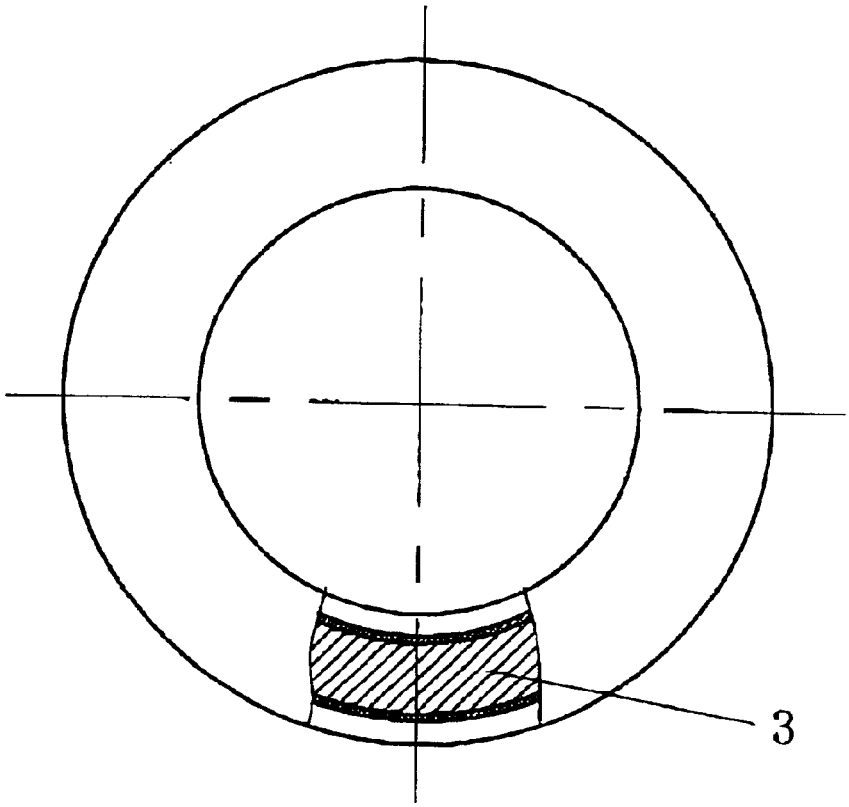
FIG. 1 is the main sketch of the round ring type cassette magnetic core structure.
Figure 2:
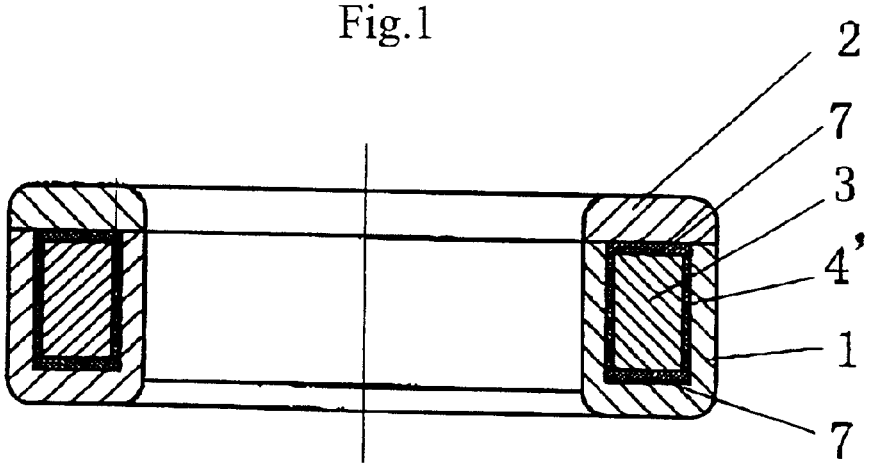
FIG. 2 is the top and sectional sketch of the round ring type cassette magnetic core structure.
Figure 5:
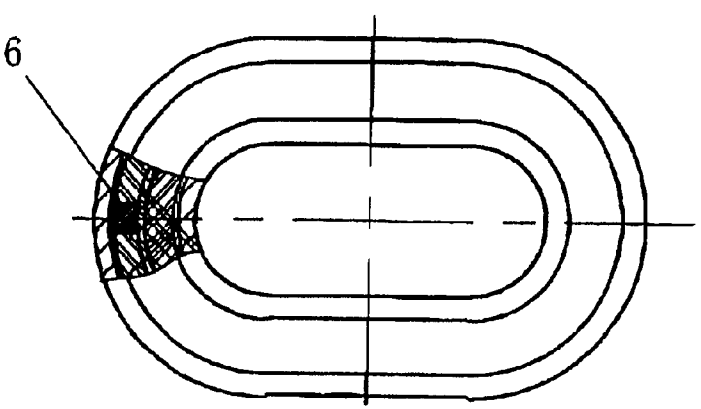
FIG. 5 is the main sketch of the oval ring type cassette magnetic core structure
Figure 6:
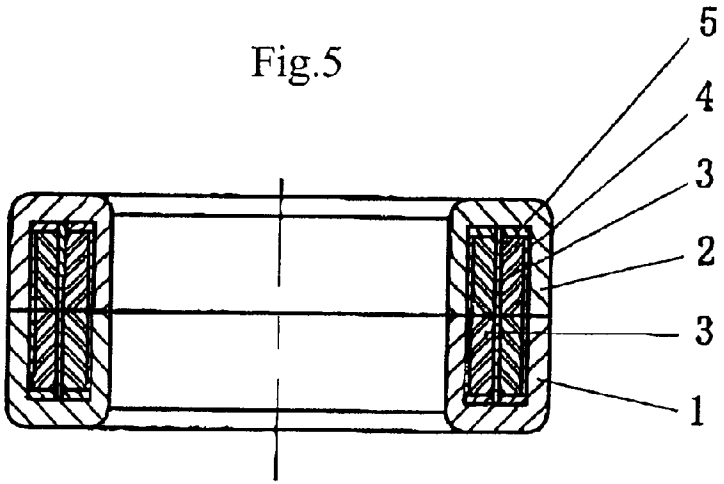
FIG. 6 is the top and sectional sketch of the oval ring type cassette magnetic core structure
Figure 3:
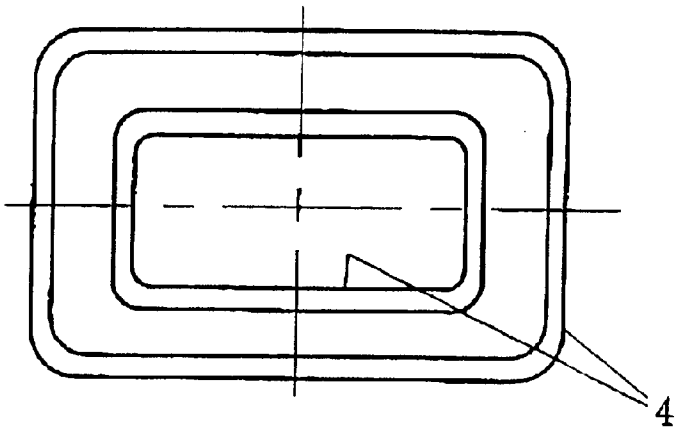
FIG. 3 is the main sketch of the rectangular ring type cassette magnetic core structure.
Figure 4:
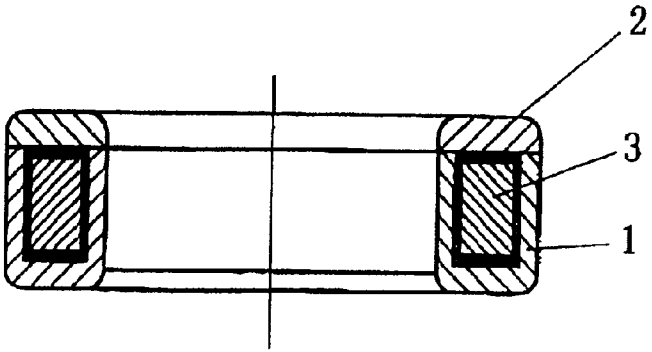
FIG. 4 is the top and sectional sketch of the rectangular ring type cassette magnetic core structure.

The box with the slot cavity and the through hole is the tubular ring box with a section of the rectangular slot cavity. The tubular ring box can be the round ring type (as shown in FIGS. 1 and 2) or oval ring type (as shown in FIGS. 3 and 4) or rectangular ring type (as shown in FIGS. 5 and 6). The so-called through hole is the central hole of the ring.

The box with the slot cavity and the through hole can be quasi-ball of twin layer wall, over which there is provided the through hole connecting the inner and outer layer walls. Between the through hole wall and the inner & outer layer wall there is formed the connected through slot cavity. Above-mentioned multiple inter-layers are of concentric spherical wall.

The tubular ring box with a section of rectangular slot cavity include a U type ring slot box body 1 and ring box-cover topped on the type opening of the U type ring slot box body.

The ring box of the rectangular tubular section includes the U type ring slot box body 1 and ring box-cover 2 of a U type ring slot form. The ring box-cover 2 of U type ring slot form will be topped on the U type ring slot box body 1.

The multiple inner magnetic core 3 installed in the multiple ring slots are made of one or multi-layers of different magnetic material or same magnetic material.

For the box with the slot cavity and the through hole, the box body 1 and box-cover 2, are made of high magnetic conductivity ferrite or power ferrite ore Ferrocart. The inner magnetic core 3 is made of high magnetic conductivity ferrite or power ferrite or Ferrocart or permalloy or non-crystal magnetic material or micro-crystal magnetic material or silicon steel.

The outerside of the box with slot cavity and the through hole is wrapped with insulation layer 4, 4'. Between the inner magnetic core 3 and slot cavity there is provided the insulation layer 4'.

Above and below the various inner magnetic cores 3 there are provided the washers 7 made of the magnetic or insulation material.

Over the inner magnetic core the opening is made. At the opening the equal-width spacers 6 made of magnetic material or insulation material.

In order to further understand the utility model, the practical embodiments are described as follows.

Embodiment 1: according to FIGS. 1 and 2, the utility model technology uses the high magnetic conductivity ferrite TL5 with initial magnetic conductivity of 5000 to make the ring type box body 1 and box-cover 2 as functional material—composite magnetic core, with ODØ34 mm, IDØ18, ring box wall thickness: 2 mm, the box height: 9 mm and the covers thickness: 4 mm, uses the 0.5 mm nylon 66 circle sleeve 4 to make the insulation layer and uses the super micro crystal (nano crystal) with initial magnetic conductivity >5000 to make the core 3 and wind them together with upper and lower magnetic insulation material washer 7 of the inner magnetic core, to produce the common mode inductance core which can be used for EMI interference resistance filter and also can be used for fabrication of the power corrector.

Embodiment 2: as shown in the FIGS. 2 and 4 the power ferrite TP4 with initial magnetic conductivity of 2500 is used to make the rectangular ring type box body 1 and box-cover 2 of composite magnetic core with length of the rectangular side: 84×54 mm, the side length of the inner hole in the ring: 60×30 mm, height of the box: 20 mm, cover thickness: 5 mm, in the rectangular ring box; there is rectangular ring type permalloy core 3 with the core thickness: 3.6 mm; on the outer wall and the inner hole wall of the rectangular box there is ABS overlay insulation layer 4 with the thickness of the core: 0.2 mm. Put the box-cover with the same outline dimension on the box, thus the magnetic core of the power transformer is made.

Embodiment 3: as shown in FIGS. 5 and 6: the Ferrocart is used to make the oval ring type ring box body 1 and ring box cover 2. In the middle of the ring box slot there is a ring of the concentric oval interlayer slot wall 5 with the thickness: 1 mm and fixed on it. The depth of the interlayers slot wall is same as the depth of the slot. Inside the two oval ring slots there are installed the magnetic cores made of super micro crystal and non-crystal magnetic material respectively. The inner ring radius of the oval box is R 20 mm, the outer ring radius is R 49 mm and the center distance is 50 mm; The height of the box cover is 25 mm and the thickness of the cover is 25 mm.

When the utility model is used for the common mode inductance core of EMI, the high magnetic conductivity ferrite was used in the past and the low frequency range is under 100 KHz and the initial magnetic conductivity is as higher as 15000, but it is much lower than the initial magnetic conductivity 60000–120000 of super micro crystal inner magnetic core. The noise reducing and filtering result of the low frequency is worse than the later. The initial magnetic conductivity of the super micro crystal magnetic core is reduced to several hundreds and several thousands gauss/oersted with the high frequency range of 100 KHz to 500 KHz or over and within this frequency range and the initial magnetic conductivity of the ferrite core can keep about 5000. So the two kinds of the soft magnetic material are combined in the composite structure to make the common mode inductance core to be used for EMI interference resistance filter to be kept within 500 KHz, so effectively improve the inserting toss of the interference filter to enhance the effectiveness of the noise reducing and filtering. At the same time the composite structure has overcome the weak point of the high stress sensitivity of the super micro crystal soft magnetic material and furthermore the price of the composite magnetic core is not very high. Therefore it has the wide market application prospect. The magnetic core also can be used for fabrication of the power corrector.

The output power of the power transformer made of the ferrite composite structure with super micro crystal, non-crystal and permalloy inner magnetic core is kept constant under proper cooling condition, different frequency range and the magnetic field intensity.

When using for output inductance, the ferrite, Ferrocart, micro crystallized, non-crystal magnetic core—composite structural magnetic core can induce the big inductance change when DC bias to cause the inductance to be increased by 10–40 times more than the max current under the low current. The feature is good for the DC output choke coil in case of switching over the power supply. This kind of the components can keep continuous operation under the very low load and using for EMI.

For the functional material—composite structural magnetic core of the utility model, its structure is simple. The requirements on different performance can be realized with simply changing the structure. The specificity of the multiple magnetic materials can be used to form the composite components with excellent comprehensive soft magnetic performance and the good electromagnetic compatibility. The stability and the sudden change of the electromagnetic characteristics can meet the requirement of the electronic technology. It has wide applicable value and the very good marketing prospect.

I claim:

1. A magnetic core having a composite structure, comprising:

an outer magnetic core having a regular geometric shape, and a through hole formed in the geometric shape, the outer magnetic core including a box having a slot cavity defined therein, and a cover that covers the slot cavity, the box and the cover being comprised of at least one of ferrite, power ferrite and Ferrocart;

an inner magnetic core disposed within the slot cavity, the inner magnetic core being comprised of at least one of ferrite, power ferrite, Ferrocart, permalloy, non-crystal magnetic material, micro-crystal magnetic material and silicon; and at least one inter-layer disposed in the slot cavity, and which divides the slot cavity into a plurality of connected ring slots, wherein the inner magnetic core includes a plurality of inner magnetic cores, each being disposed in a respective ring slot, and wherein the each inner magnetic core is comprised of a different material or same sort of material.

2. The magnetic core according to claim 1, further comprising an insulation layer, having not less than 16V insulation, attached to or covering the cover and an outer wall and inner hole wall of the box, the box having one of a round, oval and rectangular ring-shape.

3. The magnetic core according to claim 1, wherein the box has a tubular ring shape, and the slot cavity has a rectangular cross-section, the box being one of a round ring and a rectangular ring, the through hole being a central hole of the ring.

4. The magnetic core according to claim 1, wherein the box has a quasi-ball shape with a double wall, the quasi-ball shape having a through hole connecting its inner and outer walls.

5. The magnetic core according to claim 3, wherein the box has a U shape in cross section.

6. The magnetic core according to claim 1, further comprising an insulation layer that is wrapped around an outside of the box, and which is also disposed between the inner magnetic core and the slot cavity.

7. The magnetic core according to claim 1, further comprising a magnetic or insulation washer disposed at an upper and bottom side of the inner magnetic core.

8. The magnetic core according to claim 1, further comprising a magnetic or insulation spacer disposed on the inner magnetic core.

9. The magnetic core according to claim 2, wherein the insulation layer is comprised of ABS overlay, PVC, PEK, PBT, Teflon and nylon 66, and is shaped as a round, oval or rectangular ring sleeve.

10. The magnetic core according to claim 6, wherein the insulation layer is comprised of ABS overlay, PVC, PEK, PBT, Teflon and nylon 66, and is shaped as a round, oval or rectangular ring sleeve.

* * * * *